US006174249B1

(12) United States Patent
Mattoon

(10) Patent No.: US 6,174,249 B1
(45) Date of Patent: Jan. 16, 2001

(54) BASKETBALL NET INSTALLATION SYSTEM

(76) Inventor: Terry L. Mattoon, P.O. Box 265, Phelps, NY (US) 14532

( * ) Notice: Under 35 U.S.C. 154(b), the term of this patent shall be extended for 0 days.

(21) Appl. No.: 09/307,350

(22) Filed: May 6, 1999

(51) Int. Cl.[7] ..... A63B 63/08
(52) U.S. Cl. ..... 473/485; 473/489
(58) Field of Search ..... 473/447, 472, 473/479, 481, 482, 485, 487, 488, 489

(56) References Cited

U.S. PATENT DOCUMENTS 4,805,903 * 2/1989 McArdle .
4,903,964 * 2/1990 Anderson .
4,905,995 * 3/1990 Apo .
5,156,394 * 10/1992 Deal .
5,447,304 * 9/1995 Vargas .
5,575,470 * 11/1996 Sherman .
5,584,479 * 12/1996 Smith .
5,759,121 * 6/1998 Rogers et al. .

* cited by examiner

*Primary Examiner*—William M. Pierce

(57) ABSTRACT

A basketball net installation system for quickly and easily installing a basketball net on a basketball net hoop. The basketball net installation system includes a net assembly including a net and a resting frame. The resting frame has an annular lower channel therearound. The net is extended through the resting frame with an upper end of the net coupled to the resting frame. The net has a plurality of spaced apart loops coupled to the upper end of the net and outwardly radiating from the resting frame. The system also includes a mounting assembly having an annular hanging frame and a pole with a top end connected to the hanging frame with a support frame. A plurality of downwardly depending hooks are coupled to the hanging frame around the outer perimeter of the hanging frame. Each hook is inserted into a corresponding loop of the net such that the net depends from hooks.

6 Claims, 3 Drawing Sheets

BASKETBALL NET INSTALLATION SYSTEM

BACKGROUND OF THE INVENTION

1. Field of the Invention

The present invention relates to basketball net installation systems and more particularly pertains to a new basketball net installation system for quickly and easily installing a basketball net on a basketball net hoop.

2. Description of the Prior Art

The use of basketball net installation systems is known in the prior art. More specifically, basketball net installation systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,607,871; U.S. Pat. No. 4,063,768; U.S. Pat. No. Des. 345,899; U.S. Pat. No. 5,634,733; U.S. Pat. No. 1,363,456; and U.S. Pat. No. 4,471,604.

While these devices fulfill their respective, particular objectives and requirements, the aforementioned patents do not disclose a new basketball net installation system. The inventive device includes a net assembly including a net and a resting frame. The resting frame has an annular lower channel therearound. The net is extended through the resting frame with an upper end of the net coupled to the resting frame. The net has a plurality of spaced apart loops coupled to the upper end of the net and outwardly radiating from the resting frame. The system also includes a mounting assembly having an annular hanging frame and a pole with a top end connected to the hanging frame with a support frame. A plurality of downwardly depending hooks are coupled to the hanging frame around the outer perimeter of the hanging frame. Each hook is inserted into a corresponding loop of the net such that the net depends from hooks.

In these respects, the basketball net installation system according to the present invention substantially departs from the conventional concepts and designs of the prior art, and in so doing provides an apparatus primarily developed for the purpose of quickly and easily installing a basketball net on a basketball net hoop.

SUMMARY OF THE INVENTION

In view of the foregoing disadvantages inherent in the known types of basketball net installation systems now present in the prior art, the present invention provides a new basketball net installation system construction wherein the same can be utilized for quickly and easily installing a basketball net on a basketball net hoop.

The general purpose of the present invention, which will be described subsequently in greater detail, is to provide a new basketball net installation system apparatus and method which has many of the advantages of the basketball net installation systems mentioned heretofore and many novel features that result in a new basketball net installation system which is not anticipated, rendered obvious, suggested, or even implied by any of the prior art basketball net installation systems, either alone or in any combination thereof.

To attain this, the present invention generally comprises a net assembly including a net and a resting frame. The resting frame has an annular lower channel therearound. The net is extended through the resting frame with an upper end of the net coupled to the resting frame. The net has a plurality of spaced apart loops coupled to the upper end of the net and outwardly radiating from the resting frame. The system also includes a mounting assembly having an annular hanging frame and a pole with a top end connected to the hanging frame with a support frame. A plurality of downwardly depending hooks are coupled to the hanging frame around the outer perimeter of the hanging frame. Each hook is inserted into a corresponding loop of the net such that the net depends from hooks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new basketball net installation system apparatus and method which has many of the advantages of the basketball net installation systems mentioned heretofore and many novel features that result in a new basketball net installation system which is not anticipated, rendered obvious, suggested, or even implied by any of the prior art basketball net installation systems, either alone or in any combination thereof.

It is another object of the present invention to provide a new basketball net installation system which may be easily and efficiently manufactured and marketed.

It is a further object of the present invention to provide a new basketball net installation system which is of a durable and reliable construction.

An even further object of the present invention is to provide a new basketball net installation system which is susceptible of a low cost of manufacture with regard to both materials and labor, and which accordingly is then susceptible of low prices of sale to the consuming public, thereby making such basketball net installation system economically available to the buying public.

Still yet another object of the present invention is to provide a new basketball net installation system which provides in the apparatuses and methods of the prior art some of the advantages thereof, while simultaneously overcoming some of the disadvantages normally associated therewith.

Still another object of the present invention is to provide a new basketball net installation system for quickly and easily installing a basketball net on a basketball net hoop.

Yet another object of the present invention is to provide a new basketball net installation system which includes a net assembly including a net and a resting frame. The resting frame has an annular lower channel therearound. The net is extended through the resting frame with an upper end of the net coupled to the resting frame. The net has a plurality of spaced apart loops coupled to the upper end of the net and outwardly radiating from the resting frame. The system also includes a mounting assembly having an annular hanging frame and a pole with a top end connected to the hanging frame with a support frame. A plurality of downwardly depending hooks are coupled to the hanging frame around the outer perimeter of the hanging frame. Each hook is inserted into a corresponding loop of the net such that the net depends from hooks.

Still yet another object of the present invention is to provide a new basketball net installation system that allows a user to quickly install a net on a bare basketball net hoop such as those found on playgrounds and parks so that the user does not have to play basketball with a base hoop.

Even still another object of the present invention is to provide a new basketball net installation system that is easy to remove from a hoop when the user is done playing basketball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 6 thereof, a new basketball net installation system embodying the principles and concepts of the present invention will be described.

As best illustrated in FIGS. 1 through 6, the basketball net installation system generally comprises a net assembly including a net and a resting frame. The resting frame has an annular lower channel therearound. The net is extended through the resting frame with an upper end of the net coupled to the resting frame. The net has a plurality of spaced apart loops coupled to the upper end of the net and outwardly radiating from the resting frame. The system also includes a mounting assembly having an annular hanging frame and a pole with a top end connected to the hanging frame with a support frame. A plurality of downwardly depending hooks are coupled to the hanging frame around the outer perimeter of the hanging frame. Each hook is inserted into a corresponding loop of the net such that the net depends from hooks.

Figure 5:
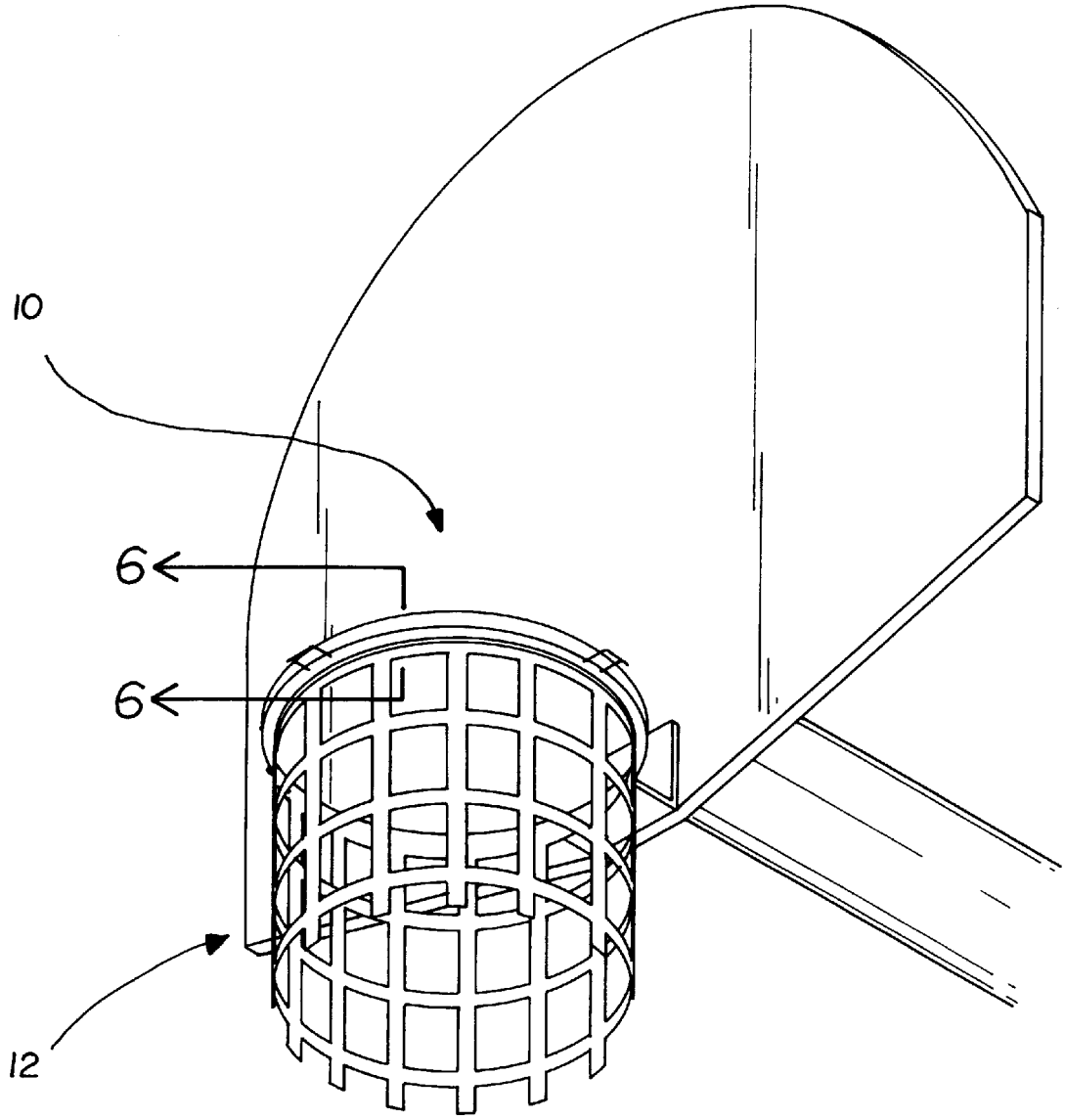
FIG. 5 is a schematic perspective view of the present invention in use on a hoop.

In use, the basketball net installation system is designed for installation on a bare basketball net hoop 10 positioned above a ground surface as best illustrated in FIG. 5. Specifically the basketball net installation system includes a net assembly 11 having a generally cylindrical flexible basketball net 12 with generally circular open upper and lower ends, a solid upper portion adjacent the upper end of the net and a latticed lower portion adjacent the lower end of the net.

Figure 6:
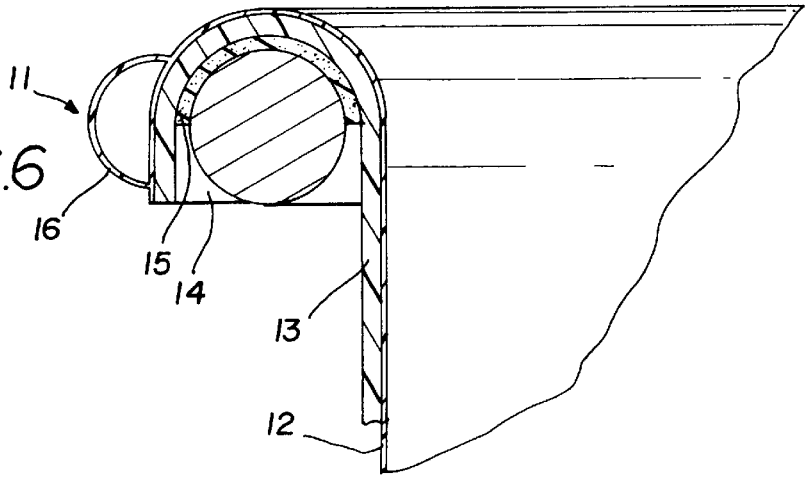
FIG. 6 is a schematic cross sectional view of the net assembly on a hoop taken from line 6—6 of FIG. 5.

As best shown in FIG. 6, the net assembly further includes an annular rigid resting frame 13 having a generally inverted J-shaped transverse cross section has a straight elongate lower portion and a generally semi-circular upper portion defining an annular lower channel 14 around the resting frame. The resting frame comprises a rigid plastic material for rigidity with light weight and a good degree of resilience.

The net is extended through the resting frame and the upper end of the net is folded over the resting frame such that the net depends from the resting frame. The upper end of the net is coupled to an exterior surface of the resting frame along both the upper and lower portions of the resting frame to secure the net to the resting frame.

Preferably, the resting frame has a resiliently deformable annular pad 15 extending around the resting frame in the lower channel of the resting frame. Ideally, the annular pad comprises a resiliently deformable neoprene material.

The net has a plurality of spaced apart vertically aligned loops 16 coupled to the upper end of the net and outwardly radiating from the resting frame. The loops are preferably spaced apart at generally equal intervals around the upper end of the net. The loops are vertically aligned on the upper end of the net (that is lie in a vertical plane) such that each loop defines a horizontally accessible space therethrough.

In use, the lower channel of the resting frame is designed for receiving therein the basketball hoop such that the resting frame is rested on the basketball hoop (see FIG. 6). The net is designed downwardly extending through the basketball hoop such that the net depends from the basketball hoop. The loops of the net are designed for positioning on the basketball hoop such that the loops outwardly radiate away from the basketball hoop.

Figure 1:
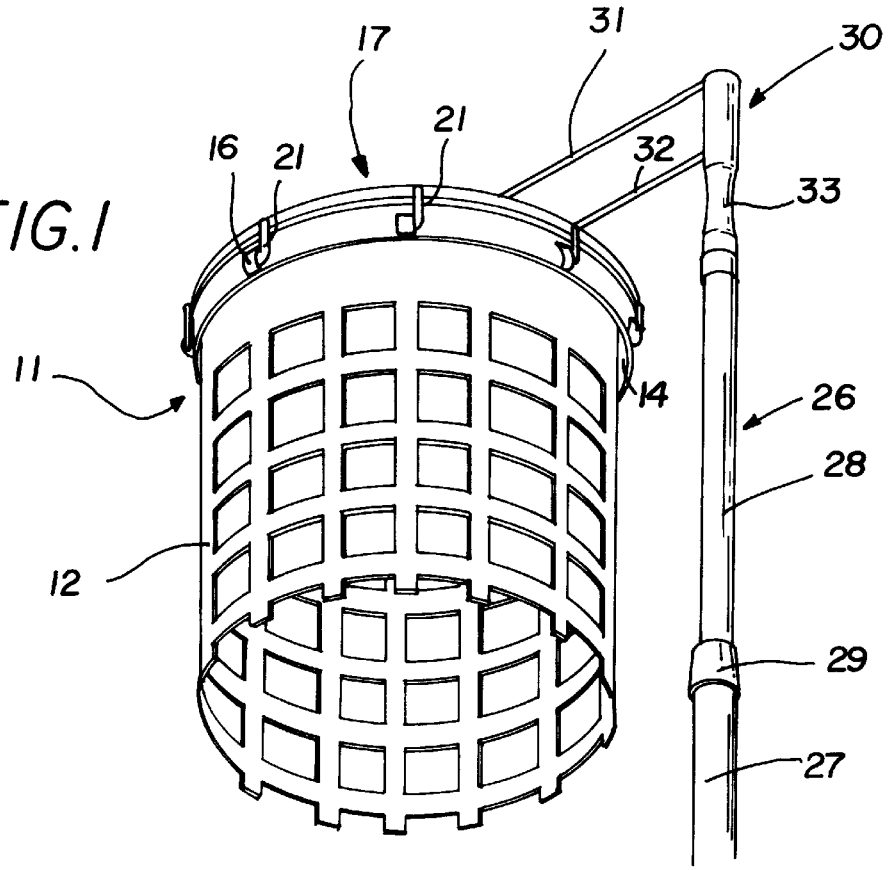
FIG. 1 is a schematic perspective view of a new basketball net installation system according to the present invention.
Figure 2:
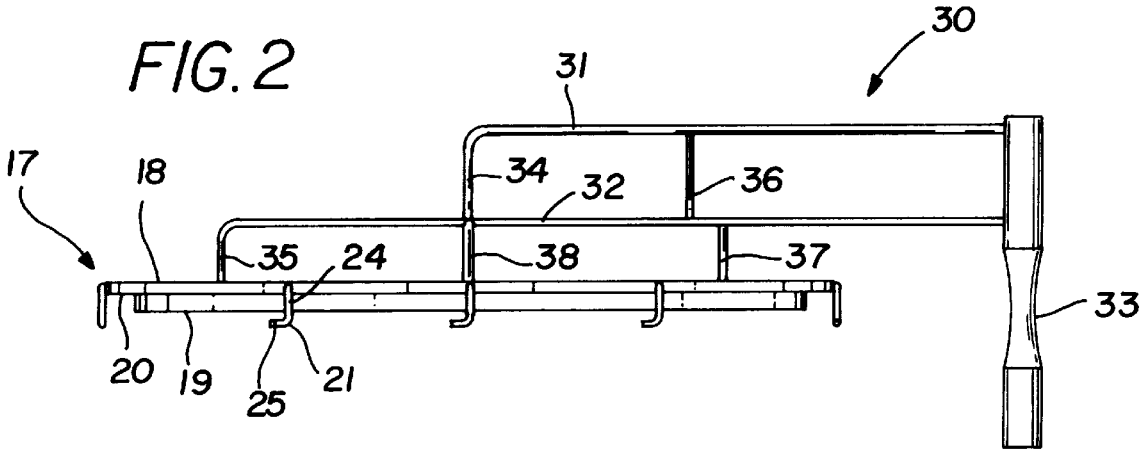
FIG. 2 is a schematic side view of the mounting assembly of the present invention.
Figure 3:
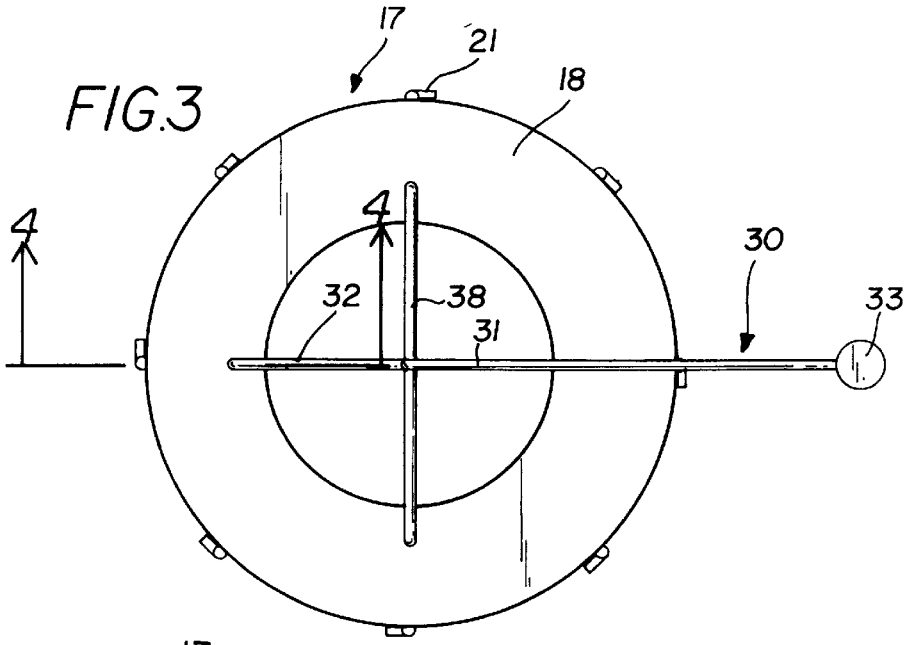
FIG. 3 is a schematic top view of the mounting assembly of the present invention.
Figure 4:
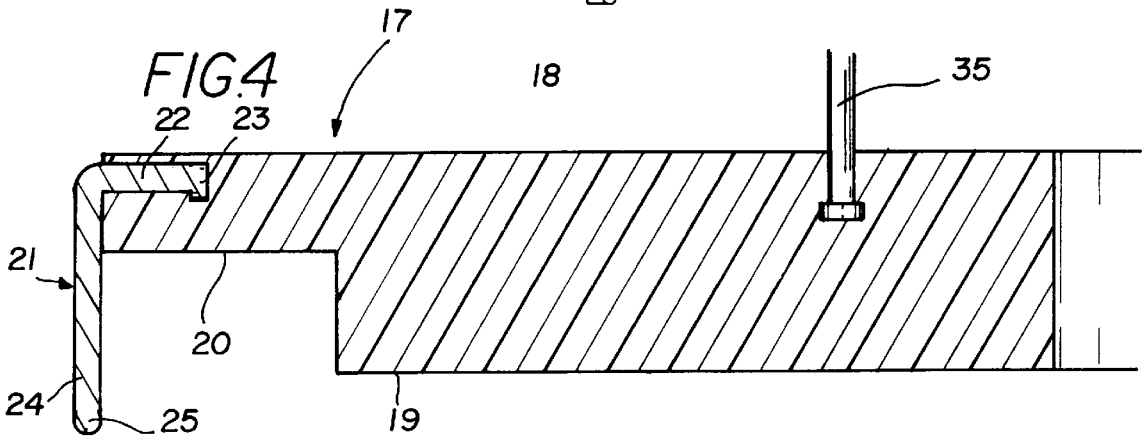
FIG. 4 is a schematic cross sectional view of the hanging frame of the present invention taken from line 4—4 of FIG. 3.

The system also includes a mounting assembly for mounting and removing the net assembly from the basketball hoop. With particular reference to FIGS. 2, 3, and 4, the mounting assembly includes an annular hanging frame 17 has substantially parallel planar annular top and bottom faces 18,19, and generally circular inner and outer perimeters.

The bottom face of the hanging frame preferably has an annular bottom shoulder 20 extending along the outer perimeter of the hanging frame. As illustrated in FIG. 4, the bottom shoulder of the hanging frame has a generally L-shaped transverse cross section defining perpendicular top and bottom portions. The top portion of the bottom shoulder is extended substantially parallel to the top and bottom faces of the hanging frame. The bottom portion of the bottom shoulder is extended substantially perpendicular to the top and bottom faces of the hanging frame. In use, the bottom shoulder is designed for receiving therein the upper end of the net and the arcuate portion of the resting frame.

A plurality of downwardly depending generally L-shaped hooks 21 are coupled to the hanging frame around the outer perimeter of the hanging frame. As best illustrated in FIG. 4, preferably each of the hooks has an upper extent 22 inserted into the hanging frame that terminates at a stop 23 in the hanging frame to couple the respective hook to the hanging frame.

Each of the hooks also has a substantially vertical elongate upper portion 24 and a substantially horizontal elongate lower portion 25 extending substantially perpendicular to the upper portion of the respective hook. The upper portions of the hooks are extended substantially perpendicular to the top and bottom faces of the hanging frame. The lower portions of the hooks are extended substantially parallel to the top and bottom faces of the hanging frame. The lower portions of the hooks are extended in a common direction around the outer perimeter of the frame (either all clockwise or all counterclockwise). In use, the lower portion of each hook is inserted into a corresponding loop of the net such that the net depends from hooks.

The mounting assembly further includes an elongate pole 26 having opposite top and bottom ends. Ideally, the pole is telescopically extendable and has an elongate bottom portion 27 telescopically receiving an elongate top portion 28, and a securing collar 29 disposed therearound to releasably hold the top and bottom portions of the pole in a fixed position with respect to one another.

The mounting assembly further comprises a support frame 30 having spaced apart upper and lower substantially parallel horizontal elongate members 31,32 outwardly extending from a handle receiver 33. The elongate members are extended substantially perpendicular to the handle receiver. The handle receiver has a threaded lower bore therein into which the top end of the pole is threaded to couple the handle receiver to the top end of the pole.

The upper and lower elongate members are coupled to the hanging frame to connect the hanging frame to the pole. Specifically, the upper and lower elongate members each have a free end and an end extent 34,35 downwardly depending from the free end of the respective elongate member. The end extent 35 of the lower elongate member is coupled to the hanging frame while the end extent 34 of the upper elongate member is coupled to the lower elongate member.

The upper and lower elongate members each also preferably have at least one downwardly depending middle extent 36,37. The middle extent of the upper elongate member is coupled to the lower elongate member and the middle extent of the lower elongate member is coupled to the hanging frame. A cross member 38 is preferably coupled to the lower elongate member and has a pair of end extents coupled to the hanging frame. The cross member is preferably extended substantially perpendicular to the lower elongate member.

In use, rotation of the pole in a direction opposite the direction the lower portions of the hooks are extended removes the hooks from the loops after the net assembly is rested on the basketball hoop. To remove the net assembly from the hoop, the mounting frame is positioned above the net assembly and rotated in the direction the lower portions of the hooks are extended to re-insert the lower portions of the hooks in the loops to couple the net assembly to the hooks of the mounting frame. The pole may then be raised to lift the mounting frame and net assembly off of the hoop.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A basketball net installation system for installation on a bare basketball net hoop, said basketball net installation system comprising:

a net assembly comprising a net having upper and lower ends;

said net assembly further comprising an annular resting frame having an annular lower channel therearound;

said net being extended through said resting frame, said upper end of said net being coupled to said resting frame;

said net having a plurality of spaced apart loops coupled to said upper end of said net and outwardly radiating from said resting frame;

a mounting assembly comprising an annular hanging frame having an outer perimeter;

a plurality of downwardly depending hooks being coupled to said hanging frame around said outer perimeter of said hanging frame;

each hook being inserted into a corresponding loop of said net such that said net depends from hooks;

said mounting assembly further comprising an elongate pole having opposite top and bottom ends; and said mounting assembly further comprising a support frame connecting said hanging frame to said top end of said pole.

2. The basketball net installation system of claim 1, wherein said resting frame has a resiliently deformable annular pad extending around said resting frame in said lower channel of said resting frame.

3. The basketball net installation system of claim 1, wherein said loops are spaced apart at generally equal intervals around said upper end of said net.

4. The basketball net installation system of claim 1, wherein said hanging frame has an annular bottom shoulder extending along said outer perimeter of said hanging frame.

5. The basketball net installation system of claim 1, wherein said pole is telescopically extendable.

6. A basketball net installation system for installation on a bare basketball net hoop, said basketball net installation system comprising:

a net assembly comprising a generally cylindrical flexible net having generally circular open upper and lower ends;

said net assembly further comprising an annular resting frame having a generally inverted J-shaped transverse cross section defining an annular lower channel around said resting frame;

said net being extended through said resting frame, said upper end of said net being folded over said resting frame, said upper end of said net being coupled to said resting frame;

said resting frame having a resiliently deformable annular pad extending around said resting frame in said lower channel of said resting frame;

said net having a plurality of spaced apart loops coupled to said upper end of said net and outwardly radiating from said resting frame;

said loops being spaced apart at generally equal intervals around said upper end of said net;

said lower channel of said resting frame being adapted for receiving therein a basketball hoop such that said resting frame is rested on the basketball hoop, said net being adapted downwardly extending through the basketball hoop such that said net depends from the basketball hoop, said loops of said net being adapted for positioning on the basketball hoop such that said loops outwardly radiate away from the basketball hoop;

a mounting assembly for mounting and removing said net assembly from the basketball hoop, said mounting assembly comprising an annular hanging frame having annular top and bottom faces, and generally circular inner and outer perimeters;

said bottom face of said hanging frame having an annular bottom shoulder extending along said outer perimeter of said hanging frame, said bottom shoulder of said hanging frame having a generally L-shaped transverse cross section defining perpendicular top and bottom portions;

said top portion of said bottom shoulder being extended substantially parallel to said top and bottom faces of said hanging frame;

said bottom portion of said bottom shoulder being extended substantially perpendicular to said top and bottom faces of said hanging frame;

a plurality of downwardly depending generally L-shaped hooks being coupled to said hanging frame around said outer perimeter of said hanging frame;

each of said hooks having a elongate upper portion and a elongate lower portion extending substantially perpendicular to said upper portion of the respective hook;

said upper portions of said hooks being extended substantially perpendicular to said top and bottom faces of said hanging frame, said lower portions of said hooks being extended substantially parallel to said top and bottom faces of said hanging frame;

said lower portions of said hooks being extended in a common direction around said outer perimeter of said frame;

said lower portions of each hook being inserted into a corresponding loop of said net such that said net depends from hooks;

said mounting assembly further comprising an elongate pole having opposite top and bottom ends;

wherein said pole is telescopically extendable; and said mounting assembly further comprising a support frame connecting said hanging frame to said top end of said pole.

* * * * *